United States Patent [19]

Byrd

[11] 4,433,864

[45] Feb. 28, 1984

[54] CAN TOP LID HOLDER

[76] Inventor: Franklin D. Byrd, 23 Elm St., Hinesville, Ga. 31313

[21] Appl. No.: 409,173

[22] Filed: Aug. 18, 1982

[51] Int. Cl.[3] ..... A47J 45/00

[52] U.S. Cl. ..... 294/27 H; 16/114 R; 220/85 H; 220/94 R

[58] Field of Search ..... 220/85 H, 94 R; 215/100 A; 294/27.1; 16/114 R, 114 A

[56] References Cited

U.S. PATENT DOCUMENTS 3,014,621 12/1961 Fovitz ..... 220/85 H 4,127,915 12/1978 Logan et al. ..... 294/27.1

*Primary Examiner*—George T. Hall

*Attorney, Agent, or Firm*—Larry Harold Kline

[57] ABSTRACT

A device is disclosed for holding a can with a tip lip comprising a structure that can be held by the user, and holding areas secured to the structure operative to be secured to the top lip of the can.

9 Claims, 10 Drawing Figures

CAN TOP LID HOLDER

This invention relates to a device for holding a can or similar object with a top lip.

Many liquids for refreshment or other purposes are packaged in containers which have a top lip. If these liquids are cold, then the user of the liquids has to hold the container in a manner where the user's hands become cold. The same is true with hot liquids. The present invention provides a device in which a container with a top lip can be held without the user touching the container. After utilization, the container can be disposed of with the holding device being reusable.

An object of the present invention is to provide a device for holding a can with a top lip in which the user of the device does not have to touch the can.

Another object of the present invention is to provide a device for holding a can with a top lip which is reusable.

A further object of the present invention is to provide a device for holding a can with a top lip which may have decals, insignias, or other ornamentation secured thereto.

Still another object of the present invention is to provide a device for holding a can with a top lip which may be held comfortably and conveniently by the user.

These and other objects and features of the invention will be apparent from the following description and appended claims.

Briefly, the invention is a device for holding a can with a top lip. The device comprises a structure that can be held by the user and a first holding area secured to the structure and operative to be secured onto the top lip of the can. A second holding area secured to the structure is also operative to be secured onto the top lip of the can.

A first gripping area on the structure may aid the user in holding the device when the first holding area is utilized. A second gripping area on the structure may aid the user in holding the device when the second holding area is utilized.

The first holding area comprises a first outer gripping finger and a first inner gripping finger. The first outer gripping finger is secured to the structure and is operative to fit over the top lip of the can and against the inner surface of the top lip. The first inner gripping finger is secured to the structure and is operative to fit under the bottom edge of the top lip. The top lip of the can is held within a first inner gripping area when the first holding area is secured to the top lip of the can.

The second holding area comprises a second outer gripping finger and a second inner gripping finger. The second outer gripping finger is secured to the structure and is operative to fit over the top lip of the can and against the inner surface of the top lip. The second inner gripping finger is secured to the structure and is operative to fit under the bottom edge of the top lip of the can. A gripping piece may be secured to the structure to aid the user in holding the device.

The invention will be more fully understood from the following detailed description and appended claims when taken with the drawings in which:

Figure 3:
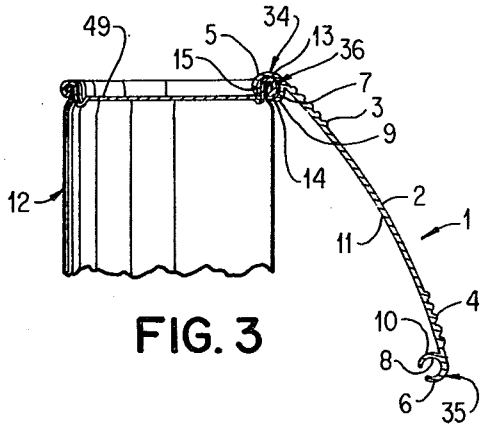

FIG. 3 is a partial sectional view of device 1 lowered into a position where it is gripping and holding can 12 utilizing holding area 34.

Figure 4:
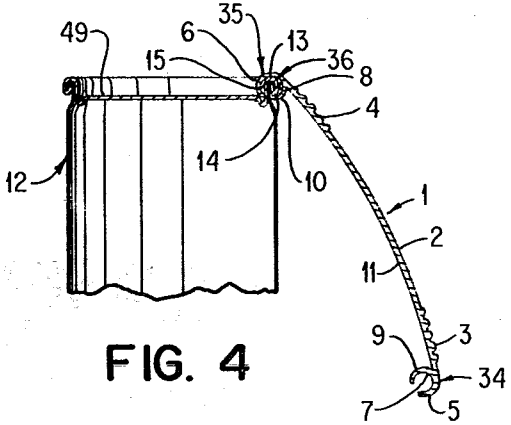

FIG. 4 is a partial sectional view of device 1 gripping and holding can 12, with the reverse holding area 35, including outer gripping finger 6 and inner gripping finger 10, holding onto can 12.

Figure 5:
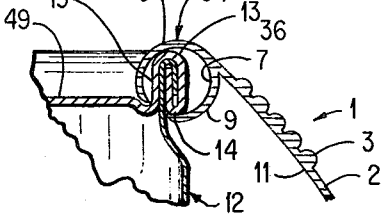

FIG. 5 is an enlarged partial sectional view of device 1 holding can 12 as shown in FIG. 3.

Figure 6:
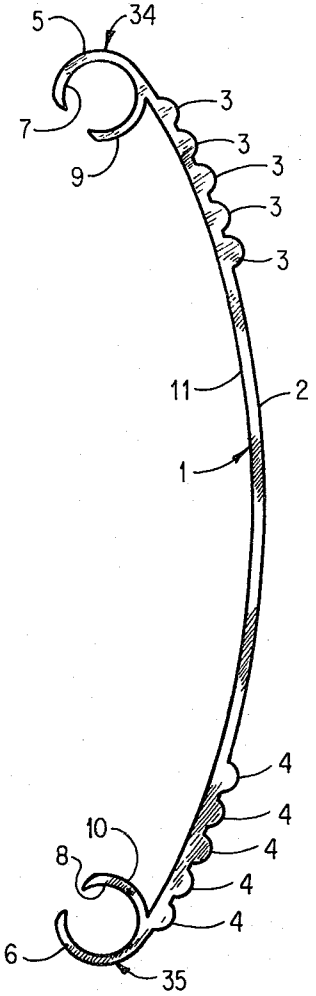

FIG. 6 is a side elevational view of device 1 showing gripping areas 3 and 4.

Figure 7:
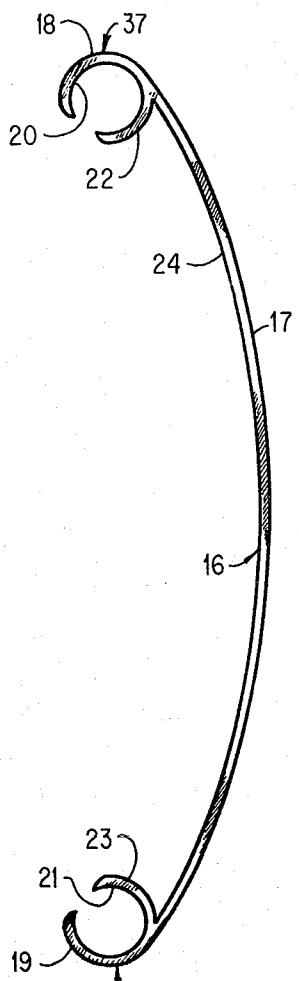

FIG. 7 is a side elevational view of device 16 which does not have gripping areas, such as gripping areas 3 and 4.

Figure 8:
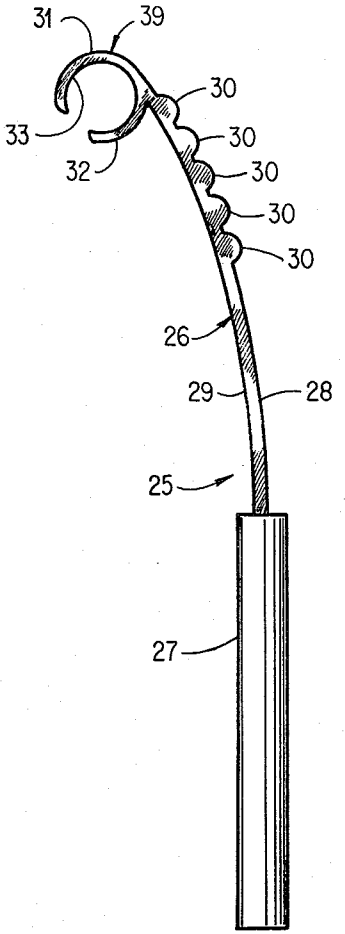

FIG. 8 is a side elevational view of device 25 which has a gripping piece 27, a gripping area 30, and a holding area 39.

Figure 9:
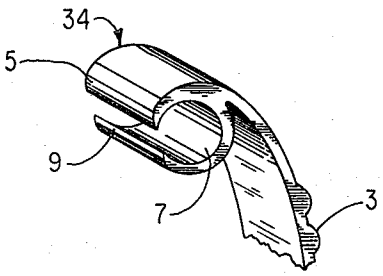

FIG. 9 is a partial isometric view of device 1 showing holding area 34.

Figure 10:
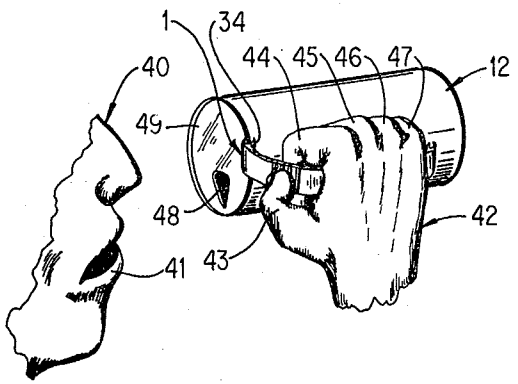

FIG. 10 is a partial isometric view showing device 1 being utilized.

Figure 1:
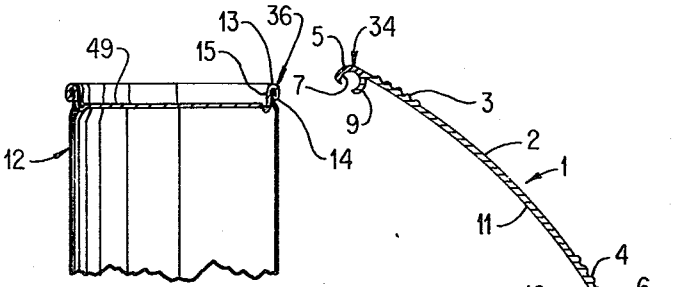
FIG. 1 is a partial sectional view of a device 1 shown detached from can 12.

Referring now to the drawings, FIG. 1 is a partial sectional view of device 1 shown detached from can 12. Device 1 has an outer face 2. On the outer face 2 are gripping areas 3 and 4. On the ends of device 1 are holding areas 34 and 35. Holding area 34 has an outer gripping finger 5 and an inner gripping finger 9, with an inner gripping area 7 between the outer gripping finger 5 and the inner gripping finger 9. Holding area 35 has an outer gripping finger 6 and an inner gripping finger 10, with an inner gripping area 8 between the outer gripping finger 6 and the inner gripping finger 10. Device 1 has an inner face 11. Can 12 has a lip 36. Lip 36 has a top 13, a bottom edge 14, and an inner surface 15.

Figure 2:
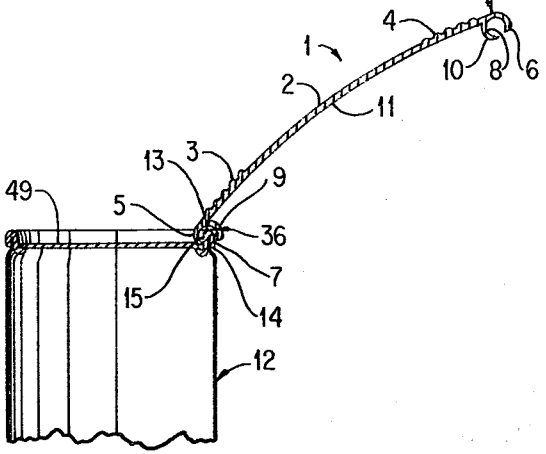
FIG. 2 is a partial sectional view of device 1 engaging can 12.

FIG. 2 is a partial sectional view of device 1 engaging can 12. The holding area 34 of device 1 is engaging lip 36 of can 12. The outer gripping finger 5 of device 1 is shown extending over the top 13 of lip 36 of can 12.

FIG. 3 is a partial sectional view of device 1 lowered into a position where it is gripping and holding can 12 utilizing holding area 34. The outer gripping finger 5 of device 1 has extended over top 13 of can 12 and is pressing against the inner surface 15 of lip 36. Inner gripping finger 9 of holding area 34 of device 1 pushes up underneath the bottom edge 14 of lip 36 of can 12. The inner gripping area 7 will press against the inner surface 15 of lip 36 of can 12 when holding area 34 is utilized. The inner gripping area 8 will press against the inner surface 15 of lip 36 of can 12 when holding area 35 is utilized.

When the device 1 held by the user, the holding area 34 holds the can 12. Gripping area 3 may be utilized to aid in holding device 1.

FIG. 4 is a partial sectional view of device 1 gripping and holding can 12, with the reverse holding area 35, including outer gripping finger 6 and inner gripping finger 10, holding onto can 12. The outer gripping finger 6 of device 1 has extended over top 13 of can 12 and is pressing against the inner surface 15 of lip 36. The inner gripping area 8 will press against the inner surface 15 of lip 36 of can 12 when holding area 35 is utilized. The inner gripping area 7 will press against the inner surface 15 of lip 36 of can 12 when holding area 34 is utilized. When device 1 is held by the user, the holding area 35 holds the can 12. Gripping area 3 may be utilized to aid in holding device 1.

FIG. 5 is an enlarged partial sectional view of device 1 holding can 12 as shown in FIG. 3. The outer gripping finger 5 extends over the top 13 of lip 36 of can 12 and presses against the inner surface 15 of lip 36. The inner gripping finger 9 presses up and under the bottom edge 14 of lip 36. When device 1 is reversed and holding area 35 is utilized, the can 12 is held in a similar manner. The holding area 34 has an inner area which is larger than lip 36 of can 12. The larger inner area enables the first outer gripping finger 5 to be extended over the top 13 of lip 36 to hook over the top 13 of lip 36 and to allow the remainder of the device 1 to be lowered in order for the inner surface 7 of the first inner gripping finger 9 to hook under the bottom edge 14 of the top lip 36.

FIG. 6 is a side elevational view of device 1 showing gripping areas 3 and 4. When holding area 34 is holding the can 12, gripping area 3 may aid in holding device 1. When holding area 35 is utilized, gripping area 4 may aid in holding device 1.

FIG. 7 is a side elevational view of device 16 which does not have gripping areas, such as gripping areas 3 and 4. Device 16 has holding areas 37 and 38. Device 16 has an outer face 17 and an inner face 24. Holding area 37 has an outer gripping finger 18, an inner gripping finger 22 and an inner gripping area 20. Holding area 38 has an outer gripping finger 19, an inner gripping finger 23, and an inner gripping area 21. The inner gripping area 20 will press against the inner surface 15 of lip 36 of can 12 when holding area 37 is utilized. The inner gripping area 21 will press against the inner surface 15 of lip 36 when holding area 38 is utilized.

FIG. 8 is a side elevational view of device 25 which has a gripping piece 27, a gripping area 30, and a holding area 39. Holding area 39 has an outer gripping finger 31, an inner gripping finger 32, and an inner gripping area 33. Device 25 has a gripping piece 27 from which extends an extension 26. Extension 26 may have a gripping area 30. Holding area 39 is secured onto extension 26. Device 25 has an outer face 28 and an inner face 29. The inner gripping area 33 will press against the inner surface 15 of lip 36 of can 12 when holding area 39 is utilized.

FIG. 9 is a partial isometric view of cevice 1 showing holding area 34. Device 1 may be of any width, length, or depth desired. Device 1 is shown having areas on opposite ends, holding areas 34 and 35, each of which may be utilized to hold can 12. Device 16 is also shown having two holding areas, holding areas 37 and 38, each of which may be utilized to hold can 12. Device 16 is shown having no gripping area, such as gripping areas 3 and 4. Device 25 has a single holding area 39 which is secured through extension 26 to gripping piece 27.

FIG. 10 is a partial isometric view showing device 1 being utilized. The user has a head 40 and a hand 42. The hand 42 has a thumb 43 and fingers 44, 45, 46, and 47. Can 12 is being supported by device 1 and is being moved toward lips 41 on the head 40 of the user. The liquid from can 12 will flow through the opening 48 in the top 49 of can 12. The thumb 43 is pressed onto the gripping area 3 of device 1. Fingers 44, 45, 46, and 47 are utilized to aid in holding device 1. Holding area 34 on device 1 is secured to lip 36 of can 12 in order for the device 1 to be utilized to drink liquid from can 12.

The device may be utilized with any type of gripping means. The device may be made from any desired material in any desired shape, utilizing any color or insignia. Decals, additions, or extensions may be added or utilized with the present invention. The holding areas may be built-up in any manner to solidify or strengthen the device. Any manner of gripping extensions or aids may be utilized with the device.

When the holding area of the device is secured onto the top lip of a can, the device may be lifted vertically which will lift the can vertically. The device can be moved horizontally or vertically when the can is held securely by the device.

To remove the device from the can, the portion of the device which is away from the holding area being utilized may be lifted and the holding area detached from the can. To secure the holding area onto the can, the upper gripping finger of the holding area is placed over the top of the lip of the can. The remainder of the device is then lowered in order for the inner surface of the holding area to press against the inner surface of the lip of the can, and for the inner gripping finger of the holding area to press against the bottom of the lip of the can.

The device can be utilized to pick up and hold a can in a manner so that the user may drink from the can in a comfortable manner. The user of the device does not have to touch the outer surface of the can while utilizing the device. The device may be re-usable and may be made from any material, such as plastic or metal, which will allow the device to function as stated herein.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for holding a can with a top lip comprising:

a. a structure that can be held by the user of said device; and b. a first holding area, with an inner area, the circumference of which is larger than the circumference of the cross-section of said top lip of said can, secured to said structure and operative to be secured onto said top lip of said can comprising:

(1) a first outer gripping finger secured to said structure and operative to fit over said top lip and against the inner surface of said top lip, hooking over said top lip and down and against said inner surface of said top lip and operative to apply a securing force to said inner surface of said top lip when said device is utilized and said top lip of said can is within said first holding area; and (2) a first inner gripping finger secured to said structure and operative to fit up, under, and against the bottom edge of said top lip, hooking under said bottom edge of said top lip and operative to apply an upward force to said bottom edge of said top lip when said device is raised vertically.

2. A device according to claim 1 further comprising a second holding area secured to said structure and operative to be secured onto said top lip of said can.

3. A device according to claim 1 further comprising a first gripping area on said structure to aid said user in holding said device when said first holding area is utilized.

4. A device according to claim 2 further comprising a second gripping area on said structure to aid said user in holding said device when said second holding area is utilized.

5. A device according to claim 4 further comprising a first gripping area on said structure to aid said user in holding said device when said first holding area is utilized.

6. A device according to claim 1 wherein said first holding area further comprises a first inner gripping area within which said top lip is held when said first holding area is secured to said top lip of said can.

7. A device according to claim 2 wherein said second holding area comprises:

a. a second outer gripping finger secured to said structure and operative to fit over said top lip and against the inner surface of said top lip; and b. a second inner gripping finger secured to said structure and operative to fit up, under, and against the bottom edge of said top lip.

8. A device according to claim 7 wherein said second holding area further comprises a second inner gripping area within which said top lip is held when said second holding area is secured to said top lip of said can.

9. A device according to claim 1 further comprising a gripping piece secured to said structure operative to aid said user in holding said device.

* * * * *